US005826512A

United States Patent [19]

Niegawa et al.

[11] Patent Number: 5,826,512

[45] Date of Patent: Oct. 27, 1998

[54] ALUMINUM PLANOGRAPHIC PRINTING PLATE WITH CONVEXLY CURVED CORNER

[75] Inventors: Kenji Niegawa; Shinichi Bunya; Naohide Ogita, all of Hasaki-machi, Japan

[73] Assignee: Mitsubishi Chemical Corporation, Tokyo, Japan

[21] Appl. No.: 659,008

[22] Filed: Jun. 4, 1996

[30] Foreign Application Priority Data

Jun. 7, 1995 [JP] Japan ..... 7-140401
Jun. 7, 1995 [JP] Japan ..... 7-140402

[51] Int. Cl.[6] ..... B41N 1/08

[52] U.S. Cl. ..... 101/454; 101/459

[58] Field of Search ..... 101/453, 454, 101/458, 459, 465

[56] References Cited

FOREIGN PATENT DOCUMENTS 0 113 521 7/1984 European Pat. Off. .
55-91696 7/1980 Japan .
59-97146 6/1984 Japan .
5-104871 4/1993 Japan .
5-104872 4/1993 Japan .
94055 4/1993 Japan ..... 101/453
7-32758 2/1995 Japan .

*Primary Examiner*—Stephen R. Funk
*Attorney, Agent, or Firm*—Oblon, Spivak, McClelland, Maier & Neustadt, P.C.

[57] ABSTRACT

An aluminum planographic printing plate includes an aluminum support and a hydrophilic layer disposed at least on one surface thereof, wherein a corner defined with a surface having the hydrophilic layer and an end face of the aluminum planographic printing plate is constituted with a convexly curved surface with no bending portion, a portion of the convexly curved surface is covered with the hydrophilic layer, and a vertical distance between an end portion of the hydrophilic layer and the flat surface of the hydrophilic layer is 10 to 60 $\mu$m.

6 Claims, 2 Drawing Sheets

ALUMINUM PLANOGRAPHIC PRINTING PLATE WITH CONVEXLY CURVED CORNER

BACKGROUND OF THE INVENTION

The present invention relates to a novel aluminum planographic printing plate and a process for producing the same. More specifically, it relates to an aluminum planographic printing plate generating no dead•line at the periphery of printed matters in a newspaper printing and a process for producing the same.

Planographic printing plates are used as a material for offset printing plate and used generally as PS (presensitized) plates. The PS plate is generally prepared by applying roughening and anodization treatments and, if necessary, hydrophilic treatment to the surface of a sheet-like or coiled aluminum plate, then coating and drying a photosensitive solution. Then, the resulting product is cut into a desired size, and packaged and supplied as a planographic printing plate. As the method of cutting, a shearing method using a flying shear, a slitter, a guillotine shear or the like is used most generally. When the PS plate is used for printing, it is subjected to exposure development with a positive or negative original film being contacted on a light sensitive layer in a plate-making step. In recent years, automatic plate processing apparatus including an automatic feed function of printing plates are often used, particularly, in newspaper printing, and the ability for the printing plate to slide of the printing plate is one of important quality problems of the planographic printing plates.

However, since end portions of the thus obtained printing plate are generally cut each at a substantially right angle, when rolled paper is printed continuously by using a rotary press such as in a in newspaper printing, a printing ink deposited on the cut surface of the printing plate is transferred to the paper since the width of the printing plate is narrower than the width of the paper to bring about a problem of causing a so-called frame-like dead•line (margin dead•line) in which ink appears as linear dead•line along margins of newspaper.

As a method of preventing such a margin dead•line, Japanese Patent Publication (KOKOKU) No. 57-46754 discloses a method of providing a notch portion at the corner on the end face of the printing plate, by using a file or the like, and Japanese Patent Application Laid-Open (KOKAI) No. 5-104871 discloses a method of applying an anodized-film treatment to such a notch portion. However, since a bending portion is present between the surface having a hydrophilic layer and the notch in each of the methods, there is a drawback that dampening water or dampening solution supplied to the surface of the hydrophilic layer upon printing can not be supplied sufficiently to the notch portion near the bending portion, thereby failing to effectively prevent the margin dead•line. Further, a method of downwardly bending the surface of a planographic printing plate described in Japanese Patent Application Laid-Open (KOKAI) No. 7-32758 also involves a problem that the effect for preventing the margin dead•line is insufficient and the ability for the printing plate to slide is not adequate, since bending occurs also at the rear face, so that this method is not suitable to the planographic printing plate. Therefore, the proposed method can scarcely provide the effect for preventing the margin dead•line, particularly, under printing conditions of feeding less amount of dampening water or dampening solution or under printing conditions of using fresh water such as in keyless-type newspaper rotary press which has been used more generally in recent years, and as a result, the improvement has been demanded.

As a result of the present inventors' earnest studies for providing a planographic printing plate causing no margin dead•line, it has been found that by bending a rather limited small portion on the surface of a hydrophilic layer near the end face along at least two opposing end faces of an aluminum planographic printing plate having the hydrophilic layer disposed on the surface of an aluminum support, forming a convexly curved surface with no bending portion at the corner and forming the hydrophilic layer on a portion of the convexly curved surface, the obtained aluminum planographic printing plate cause no dead•line to the periphery of printed matters, can prevent dead•line on the surface of printed paper with an ink deposited to the cut surface, and has no burrs or bow on the rear face, thereby showing satisfactory ability for the printing plate to slide in an automatic plate processing machine. The present invention has been accomplished based on the above-mentioned findings.

SUMMARY OF THE INVENTION

It is an object of the present invention to provide an aluminum planographic printing plate causing no margin dead•line to the periphery of printed matters, capable of providing satisfactory printing and capable of being processed with no trouble also in an automatic printing plate processing machine.

The accomplish the aims, in a first aspect of the present invention, there is provided an aluminum planographic printing plate comprising an aluminum support and a hydrophilic layer disposed at least on one surface thereof, a corner defined with a surface having the hydrophilic layer and an end face of the aluminum planographic printing plate being constituted with a convexly curved surface with no bending portion, a portion of said convexly curved surface being covered with said hydrophilic layer, and a vertical distance between an end portion of the hydrophilic layer and the flat surface of the hydrophilic layer being 10 to 60 $\mu$m.

In a second aspect of the present invention, there is provided a method of manufacturing a planographic printing plate, which comprises cutting a planographic printing plate comprising an aluminum support and a hydrophilic layer disposed at least on one surface thereof by using a shearing-type cutting machine, the angle of the top end of upper and lower cutting blades being substantially at a right angle.

DETAILED DESCRIPTION OF THE INVENTION

The planographic printing plate having a hydrophilic layer disposed on at least one surface of an aluminum support used in the present invention may be any of known printing plates providing that the hydrophilic layer is formed on the surface of the aluminum support by hydrophilic treatment applied to the aluminum support, with or without a light sensitive layer applied on the hydrophilic layer.

In the aluminum planographic printing plate according to the present invention, a corner defined with the surface having the hydrophilic layer and the end face of the aluminum planographic printing plate is constituted with a convexly curved surface having no bending portion at least on two opposing end faces of the aluminum planographic printing plate, and a portion of the convexly curved surface is covered with a hydrophilic layer.

Figure 1:
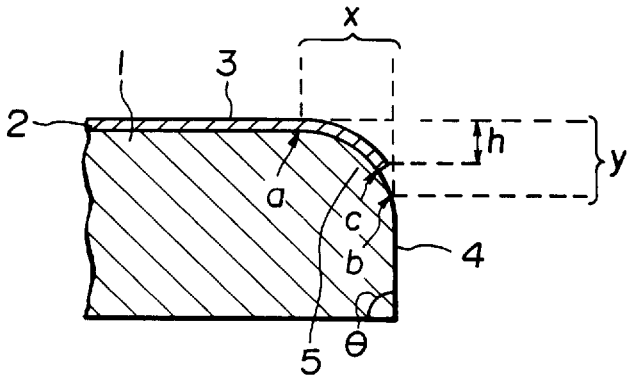
FIG. 1 is a schematic enlarged view for a cross section of an aluminum planographic printing plate according to the present invention.
Figure 2:
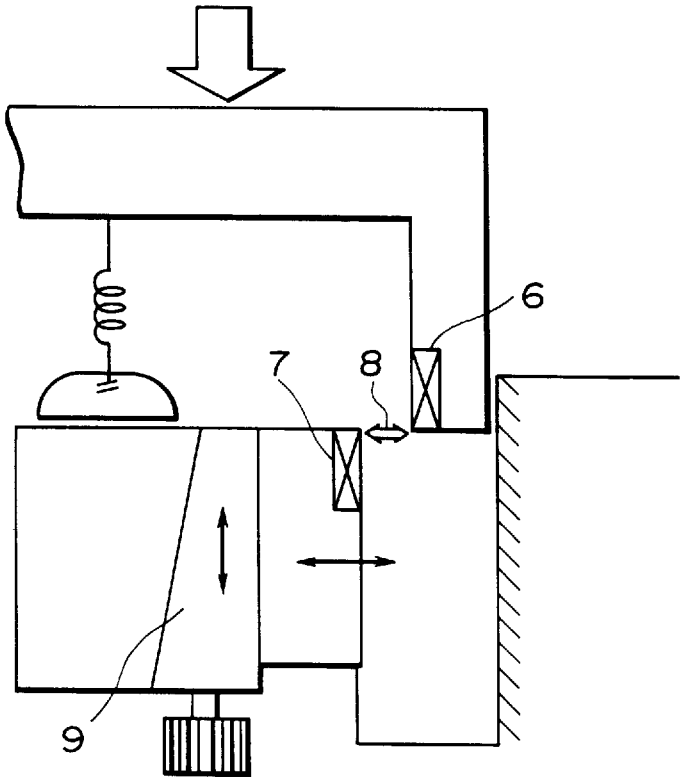
FIG. 2 is a cross sectional view for a principal portion of a cutting machine used for manufacture of an aluminum planographic printing plate according to the present invention.

Referring more specifically based on the drawings, FIG. 1 is an enlarged cross sectional view for the end of an aluminum planographic printing plate according to the present invention prepared by a shearing-type cutting machine, a main portion of which is shown as a cross section in FIG. 2.

In FIG. 1, are shown an aluminum support (1), a hydrophilic layer (2), a surface (3) of the hydrophilic layer (flat surface of the hydrophilic layer), a face (4) at the end (end face) of the aluminum support, and a convexly curved surface (5) having no bending portion. a denotes a contact point between the convexly curved surface and the flat surface of the hydrophilic layer, b denotes a contact point between the convexly curved surface and the end face, c denotes the end of the hydrophilic layer and θ denotes an angle between the end face and a rear face of aluminum planographic printing plate. In the aluminum planographic printing plate according to the present invention, the corner defined with the surface (3) having the hydrophilic layer and the end face (4) is constituted with a convexly curved surface (5) (that is a curved surface from a to b not having the bending portion) and a specified range of the curved surface is covered with the hydrophilic layer, thereby enabling to eliminate the margin dead•line.

There is no particular restriction for a horizontal distance (x) between the end face (4) of the aluminum support and the contact point (a) constituted by the convexly curved surface and the flat surface of the hydrophilic layer; and a vertical distance (y) between the flat surface (3) of the hydrophilic layer and the contact point (b) constituted by the convexly curved surface and the end face (4) of the aluminum support. Each of the horizontal distance (x) and vertical distance (y) is preferably 50 to 200 μm, preferably 70 to 180 μm. If each of the horizontal distance (x) and vertical distance (y) is less than 50 μm, it is difficult to form a sufficient convexly curved surface, sometimes making it insufficient to provide a margin dead•line preventive effect. On the other hand, if it exceeds 200 μm, the convexly curved surface may become excessive to sometimes cause burrs or bend on the rear face of the aluminum support resulting in the generation of the transportation failures in an automatic printing plate processing machine.

In the planographic printing plate according to the present invention, the angle (θ) made between the end face and the rear face is preferably within a range of 75° to 115°, preferably from 80° to 100° in view of the ability for the printing plate to slide in automatic printing plate processing. Further, it is preferred that the angle is substantially at a right angle.

In the planographic printing plate according to the present invention, it is particularly necessary that the amount of sagging of the hydrophilic layer film extended on the convexly curved surface, that is, a vertical distance (h) between the end portion of the hydrophilic layer (c) and the flat surface (3) of the hydrophilic layer is within a range 10 to 60 μm, preferably from 20 to 60 μm. By adjusting the vertical distance (h) within the above-mentioned range, cracks caused to the hydrophilic layer film, particularly, the hydrophilic layer film on the convexly curved surface can be controlled preferably.

If the vertical distance (h) is less than 10 μm, an ink is deposited to the non-hydrophilic portion on the convexly curved surface, thereby failing to attain a sufficient effect for preventing the margin dead•line. On the other hand, if the vertical distance (h) exceeds 60 μm, cracks in the hydrophilic layer become large, for example, the width of crack become not less than 4 μm, whereby an ink sticks in the crack during printing to cause linear margin dead•line on the paper surface. The vertical distance (h) is preferably 20 to 60 μm, more preferably 25 to 55 μm.

As a method of preparing an aluminum planographic printing plate according to the present invention, there can be used a method comprising roughening the surface of an aluminum sheet, applying anodization and hydrophilic treatment to form a grained plate, cutting the resultant grained plate and then coating with a photosensitive solution and drying; or a method comprising roughening the surface of an aluminum sheet, applying anodization and a hydrophilic treatment to prepare a grained plate, further coating with a light sensitive solution and drying, and then cutting the resultant plate. In each of the methods, there is no particular restriction on the cutting method, providing that the hydrophilic layer on the opposing two or four cut surfaces becomes a convexly curved surface with no flex portion by the cutting method. Various known cutting methods may also be adopted by properly adjusting, for example, a gap between upper and lower blades. However, since a shearing-type guillotine shear, flying shear, slitter or the like with a sharp blade edge not using a blade of a right angle used for cutting thin materials such as planographic printing plates, the cut surface is usually fabricated into a right angle and tends to cause so-called burrs and bow in which the both the surface and the rear face of the planographic printing plate are bent in parallel with each other, so that no desired end shape in the present invention can be obtained easily.

Particularly, as shown by a cross sectional view for a main portion in FIG. 2, when a shearing machine of shear force fabrication-type having upper and lower cutting blades substantially of a right angle, specifically, a shearing-type punching machine or a guillotine shear having such cutting blades is used, it is possible to effectively manufacture a planographic printing plate of the present invention while minimizing occurrence of burrs or bow. Also in this case, a planographic printing plate of the present invention having a desired end shape can be obtained by properly selecting a clearance between upper and lower blades, and it is preferable to adjust the clearance between the upper and lower blades to 7 to 20%, preferably 10 to 20% based on the thickness of the planographic printing plate since the generation of cracks having crack width of not less than 4 μm in the hydrophilic layer on the convexly curved surface can be suppressed. It is also possible to disposed a cushioning material such as paper or film (thickness: 10 to 100 μm) between the aluminum plate and the lower blade upon cutting, in which the planographic printing plate of the present invention can be manufactured effectively by adjusting the clearance between the upper and lower blades to 10% to 40%, preferably 20 to 40% based on the sum of the thickness of the planographic printing plate and cushioning material.

In the cutting machine shown in FIG. 2, the clearance (8) between an upper blade (6) and a lower blade (7) is adjusted by a clearance adjusting mechanism (9).

The aluminum plate having the hydrophilic layer disposed on the surface is degreased by a known method, then subjected to surface thereof roughening by chemical polishing, mechanical polishing, electrochemical polishing or a combination thereof, further subjected to anodization, for example, in a sulfate bath to form an anodized film, and further subjected to a hydrophilic treatment to prepare a grained plate.

There is no particular restriction on the light sensitive solution, and a light sensitive solution used generally for forming a light sensitive layer in conventional light sensitive planographic printing plates can be used. For example, a light sensitive solution containing a diazo resin and a hydrophobic resin; a light sensitive solution containing an o-quinone diazido compound and a novolac resin; and a light sensitive solution containing an addition polymerizable unsaturated monomer, a photopolymerization initiator and an organic polymeric compound may be exemplified.

Referring to an example of a method of manufacturing an aluminum planographic printing plate used in the present invention, the process comprises adhering under vacuum a desired original film to the surface of a light sensitive layer of the planographic printing plate, then selectively irradiating active rays such as UV-rays to cause a difference of solubility to a liquid developer between the irradiated area, and the non-irradiated area and then applying development to form a relief image for the original film. If necessary, a gum treatment may be applied.

By using the aluminum planographic printing plate according to the present invention, a planographic printing plate for newspaper which causes no dead•line to the periphery of printed matters and is suitable also to transportation by an automatic printing plate processing machine or the like can be provided industrially.

In addition, the method according to the present invention can mass produce aluminum planographic printing plates capable of preventing dead•line on the surface of printed paper by an ink deposited to cut surfaces, with no burrs nor bow on the rear face and having preferred ability for the printing plate to slide in automatic printing plate processing machines, with no provision of particular facilities, which can provide a great industrial value.

EXAMPLES

The present invention is to be explained more in details by way of examples but the present invention is not restricted only to such examples.

Examples 1 and Comparative Examples 1–5

A coiled aluminum plate of 0.3 mm in thickness was subjected to degreasing, electrolytic polishing and anodization to form an anodized film according to a customary method, which was then further subjected to a pore sealing treatment, water washing and drying to prepare a grained plate.

A negative light sensitive solution was coated and dried on the grained plate to obtain a negative light sensitive planographic printing plate. The thickness of the printing plate was about 0.3 mm.

Then, using the thus obtained printing plate, the following 9 kinds of specimens A–J of different end shapes were prepared.

Figure 3:
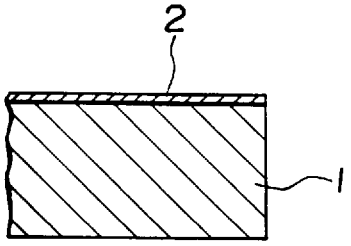
FIG.3 PRIOR ART
FIG. 3 is a schematic enlarged view for a cross section of an aluminum planographic printing plate of Comparative Example 1.

Specimen A: A printing plate having a cut face with a right angle shown in FIG. 3 (prepared by a guillotine shear having a single blade of a sharp blade edge).

Specimen B: A printing plate having an end portion with a notch portion at 45° by a knife.

Figure 4:
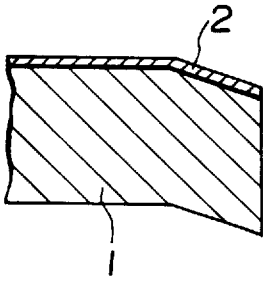
FIG.4 PRIOR ART
FIG. 4 is a schematic enlarged view for a cross section of an aluminum planographic printing plate of Comparative Example 3.

Specimen C: A printing plate with a cut surface of a shape bent downwardly shown in FIG. 4 (prepared by a slitter, with the vertical distance (h) of 30 μm).

Specimens E–H: Printing plates each having a corner at the end portion constituted with a convexly curved surface with no bending portion and covered at a portion thereof with a hydrophilic layer shown in FIG. 1 (prepared by using a shearing-type cutting machine having upper and lower cutting blades each of a right angle shown in FIG. 2, and by cutting with a clearance between the upper and lower blades shown in Table 1 respectively).

Specimen J: A printing plate having a corner at the end portion defined with a convexly curved surface with no bending portion and covered at a portion thereof with a hydrophilic layer shown in FIG. 1 (prepared by using a shearing-type cutting machine having upper and lower cutting blades each of a right angle shown in FIG. 2 and by cutting while interposing a 50 μm PET film between the lower blade and the PS plate and with a 100 μm clearance between the upper and lower blades).

When the specimens were exposed imagewise, then subjected to development to prepare a printing plate specimens, printed by a printer and evaluated for printing, the following results of evaluation were obtained. The results are shown in Table 1.

The state of occurrence of margin dead•line was evaluated by the following standards.

(Evaluation Standard for Dead•Line)

AA: No dead•line formed at all

BB: Intermittent dead•line formed

CC: Fine linear dead•line formed

DD: Fat linear dead•line formed

It is required in view of practical use that the standards for evaluation are AA or BB.

The state of cracks in the hydrophilic layer of the obtained printing plate was observed by scanning electronmicroscope (angle: 90°, magnification: 500) and evaluated by the following standards.

(Evaluation Standards for Cracks in Hydrophilic Layer)

Width:

AA: Crack width is small (less than 2 μm)

BB: Crack width is medium

CC: Crack width is large (not less than 4 μm)

It is required in view of practical use that the evaluation standards are AA or BB.

TABLE 1

| Examples | Specimenn | Clearance between upper and lower blade (μm) | Presence or absence of PET film | Horizontal distance (x) (μm) |
|---|---|---|---|---|
| Comp. Ex.1 | A | — | — | — |
| Comp. Ex. 2 | B | — | — | — |
| Comp. Ex. 3 | C | — | — | — |
| Ex. 1 | D | 40 | Absence | 70 |

TABLE 1-continued

| | | | | |
|---|---|---|---|---|
| Comp. Ex. 4 | E | 20 | Absence | <50 |
| Comp. Ex. 2 | F | 50 | Absence | 130 |
| Comp. Ex. 5 | G | 100 | Absence | 150 |
| Ex. 3 | H | 60 | Absence | 142 |
| Ex. 4 | J | 100 | Presence | 140 |

| Examples | Vertical distance (y) (μm) | Cracks in hydrophilic layer width (μm) | Vertical distance (h) | State of occurrence of margin dead.line |
|---|---|---|---|---|
| Comp. Ex. 1 | — | — | — | DD |
| Comp. Ex. 2 | — | — | 0 | CC |
| Comp. Ex. 3 | — | — | 30 | CC |
| Ex. 1 | 100 | AA | 25 | CC |
| Comp. Ex. 4 | <50 | AA | about 0 | CC |
| Ex. 2 | 170 | BB | 35 | BB |
| Comp. Ex. 5 | 200 | CC | 70 | DD |
| Ex. 3 | 185 | BB | 55 | BB |
| Ex. 4 | 180 | AA | 50 | BB |

The distinct margin dead•line occurred in the specimen A and fine margin dead•line occurred also in specimens B and C.

On the other hand, the specimens D, F, H and J which are products according to the present invention showed scare or no marginal dead•line, were satisfactory and provided a significant effect for remarkably suppressing occurrence of margin dead•line. Further, even when a shearing-type cutting machine having upper and lower blades each of a right angle was used, the effect of suppressing occurrence of margin dead•line was insufficient if the vertical distance (h) is less than 10 μm (specimen E), and cracks having crack width of not less than 4 μm, occurred remarkably in the hydrophilic layer to cause the margin dead•line by the deposition of the ink to the portion if the vertical distance (h) was more than 60 μm (specimen G). That is, it can be seen that the planographic printing plate can be attained effectively in a shearing-type cutting machine having upper and lower cutting machine each about at a right angle, without using a cushioning material, by adjusting the clearance between the upper and lower blades to 7% to 20% based on the thickness of the planographic printing plate.

What is claimed is:

1. An aluminum planographic printing plate comprising an aluminum support and a hydrophilic layer disposed at least on one surface thereof, a corner defined with a surface having the hydrophilic layer and an end face of the aluminum support being constituted only with a convexly curved surface, a portion of said convexly curved surface being covered with said hydrophilic layer, and a vertical distance between an end portion of the hydrophilic layer and a flat surface of the hydrophilic layer being 10 to 60 μm.

2. An aluminum planographic printing plate according to claim 1, wherein the vertical distance between the end portion of the hydrophilic layer and the flat surface of the hydrophilic layer is 20 to 60 μm.

3. An aluminum planographic printing plate according to claim 1, wherein the angle formed between the end face and a rear face is within a range of 75° to 115°.

4. An aluminum planographic printing plate according to claim 3, wherein the angle formed between the end face and the rear face is substantially at a right angle.

5. An aluminum planographic printing plate according to claim 1, wherein a horizontal distance between the end face of the aluminum support and a contact point constituted by the convexly curved surface and the flat surface of the hydrophilic layer is 50 to 200 μm.

6. An aluminum planographic printing plate according to claim 1, wherein a vertical distance between the flat surface of the hydrophilic layer and a point of contact constituted by the convexly curved surface and the end face of the aluminum support is 50 to 200 μm.

* * * * *